US009466888B2

(12) United States Patent
Rogers

(10) Patent No.: US 9,466,888 B2
(45) Date of Patent: Oct. 11, 2016

(54) SUPPRESSING MODES IN AN ANTENNA FEED INCLUDING A COAXIAL WAVEGUIDE

(71) Applicant: Honeywell International Inc., Morristown, NJ (US)

(72) Inventor: Shawn David Rogers, Johns Creek, GA (US)

(73) Assignee: Honeywell International Inc., Morris Plains, NJ (US)

( * ) Notice: Subject to any disclaimer, the term of this patent is extended or adjusted under 35 U.S.C. 154(b) by 385 days.

(21) Appl. No.: 13/975,676

(22) Filed: Aug. 26, 2013

(65) Prior Publication Data

US 2015/0054702 A1 Feb. 26, 2015

(51) Int. Cl.

| | |
|---|---|
| ***H01Q 15/24*** | (2006.01) |
| ***H01Q 19/06*** | (2006.01) |
| ***H01Q 13/00*** | (2006.01) |
| ***H01P 1/162*** | (2006.01) |
| ***H01P 1/17*** | (2006.01) |
| ***H01P 5/103*** | (2006.01) |
| ***H01Q 13/08*** | (2006.01) |

(52) U.S. Cl.

CPC ..... *H01Q 15/242* (2013.01); *H01P 1/162* (2013.01); *H01P 1/17* (2013.01); *H01P 5/103* (2013.01); *H01Q 13/00* (2013.01); *H01Q 13/08* (2013.01); *H01Q 19/06* (2013.01); *Y10T 29/49016* (2015.01)

(58) Field of Classification Search

CPC ..... H01Q 15/24; H01Q 13/00; H01Q 19/06
USPC ..... 343/753, 756; 29/600
See application file for complete search history.

(56) References Cited

U.S. PATENT DOCUMENTS

| | | | |
|---|---|---|---|
| 3,508,277 | A | 4/1970 | Ware et al. |
| 3,945,013 | A | 3/1976 | Brunner et al. |
| 4,041,499 | A | 8/1977 | Liu et al. |
| 4,556,853 | A | 12/1985 | Clark |
| 4,558,290 | A | 12/1985 | Lee |
| 4,570,134 | A | 2/1986 | Woodward |
| 4,675,633 | A | 6/1987 | Young |
| 5,227,744 | A | 7/1993 | Sabatier |
| 8,013,687 | B2 | 9/2011 | Espino et al. |

(Continued)

OTHER PUBLICATIONS

Limebear, "A 2m Helical Aerial for Satellite Communications", "Radio Communications Issue 11", Nov. 1974, pp. 748-752, vol. 50.

(Continued)

*Primary Examiner* — Dameon E Levi
*Assistant Examiner* — Andrea Lindgren Baltzell
(74) *Attorney, Agent, or Firm* — Fogg & Powers LLC

(57) ABSTRACT

An antenna feed with mode suppression includes a transition section, having a window for connecting to an output port of a waveguide and having inner and outer conductors forming a coaxial waveguide that couples energy from the waveguide into a horizontal $TE_{11}$ mode in the coaxial waveguide. A polarizer section is coupled to the transition section and generates circular polarization from the horizontal mode of the transition section. A radiator section is coupled to the polarizer and provides an output signal for the antenna feed. The transition section includes an electrical short coupling the inner and outer conductors. The electrical short is disposed adjacent to the window of the transition section. A dielectric block is also disposed between the inner and outer conductors and adjacent to the electrical short along the axis of the coaxial waveguide. A surface of the dielectric block is coated with a thin film sheet resistance.

19 Claims, 13 Drawing Sheets

(56) References Cited

U.S. PATENT DOCUMENTS

| | | | | |
|---|---|---|---|---|
| 2005/0173382 | A1* | 8/2005 | Ishii | H01J 37/32192 219/121.43 |
| 2010/0194500 | A1* | 8/2010 | Suzuki | H04B 5/0018 333/237 |
| 2015/0214616 | A1 | 7/2015 | Rogers et al. | |

OTHER PUBLICATIONS

Munk, "Jaumann and Circuit Analog Absorbers", "Frequency Selective Surfaces, Theory and Design", 2000, pp. 315-319, Publisher: John Wiley and Sons, Inc.

Pozar, "3.5 Coaxial Line", "Microwave Engineering, 2nd Edition", 1998, p. 145, Publisher: John Wiley and Sons, Inc.

Targonski, "A Multiband Antenna for Satellite Communications on the Move", "IEEE Transactions on Antennas and Propagation", Oct. 2006, pp. 2862-2868, vol. 54, No. 10.

European Patent Office, "Extended EP Search Report from EP Application No. 14172242.1 mailed Jan. 23, 2015", "from Foreign Counterpart of U.S. Appl. No. 13/975,676", Jan. 23, 2015, pp. 1-6, Published in: EP.

* cited by examiner

SUPPRESSING MODES IN AN ANTENNA FEED INCLUDING A COAXIAL WAVEGUIDE

GOVERNMENT RIGHTS

The U.S. Government may have rights in the invention under Government Contract No. H94003-04-D-0005 awarded by the U.S. Government to Northrop Grumman.

BACKGROUND

In wireless communication systems, electromagnetic radiation is transmitted from one or more antennas to communicate information. One characteristic of the electromagnetic radiation is its polarization. Polarization is a property that describes the orientation of the oscillation of the electromagnetic radiation.

Electromagnetic radiation has electric and magnetic fields that are perpendicular to each other and perpendicular to the direction of wave propagation. The electric field can be defined by a vector having X and Y components and traveling in the Z direction of a coordinate system. The polarization of the electromagnetic radiation is defined by specifying the orientation of the electric field vector at a point in space over a period of oscillation. If the X and Y components of the electric field have a sinusoidal oscillation with the same amplitude and are 90 degrees out-of-phase with each other, then the polarization is circular because the electric field vector traces out a circle in the X-Y plane. If the amplitude of the X and Y components are not the same, or if the phase difference varies from 90 degrees, then the polarization is defined as elliptical. In general, all polarizations can be considered elliptical. Circular and linear polarizations are special cases of elliptical polarization.

In some systems, the electromagnetic radiation is intended to be transmitted with circular polarization. Unfortunately, perfect circular polarization cannot be achieved in practical systems as there is always some, however small, polarization error. One measure of the quality of circular polarization is referred to as "axial ratio."

Axial ratio can be calculated from the right hand and left hand circular components of the radiated electric fields as shown in equations (1)-(4) below. The left hand and right hand components are calculated from the complex X and Y components of the electric field as shown. Note: $j=\sqrt{(-1)}$.

$$E_L = E_x - jE_y \tag{1}$$

$$E_R = E_x + jE_y \tag{2}$$

$$AR = \left|\frac{|E_R| + |E_L|}{|E_R| - |E_L|}\right| \tag{3}$$

$$AR(\text{dB}) = 20\log_{10}\left|\frac{|E_R| + |E_L|}{|E_R| - |E_L|}\right| \tag{4}$$

A channel with two communicating antennas having axial ratio greater than 0 dB will experience a polarization loss. Kales, M. L., "Techniques for Handling Elliptically Polarized Waves with Special Reference to Antennas: Part III-Elliptically Polarized Waves and Antennas", Proceedings of the IRE, Volume: 39, Issue: 5: 1951, pp.: 544-549 shows in detail how to calculate the polarization loss factor (PLF) that must be applied in link budgets. As an example, two antennas with 4 dB axial ratio can have a maximum PLF of 0.9 dB. If the channel has one antenna with 1 dB AR and a second antenna with 3 dB AR, then the maximum PLF is 0.2 dB. It is desirable to minimize the PLF which can be done by minimizing each antenna's axial ratio. Therefore, there is a need in the art for improvements that reduce axial ratio in systems using circular polarization.

SUMMARY

In one embodiment, an antenna feed with mode suppression includes a transition section, having a window for connecting to an output port of a waveguide and having inner and outer conductors forming a coaxial waveguide that couples energy from the rectangular waveguide into a horizontal TE11 mode in the coaxial waveguide. A polarizer section is coupled to the transition section and generates circular polarization from the horizontal mode of the transition section. A radiator section is coupled to the polarizer and provides an output signal for the antenna feed. The transition section includes an electrical short coupling the inner and outer conductors. The electrical short is disposed adjacent to the window of the transition section. A dielectric block is also disposed between the inner and outer conductors and adjacent to the electrical short along the axis of the coaxial waveguide. A surface of the dielectric block is coated with a thin film sheet resistance.

BRIEF DESCRIPTION OF THE DRAWINGS

Understanding that the drawings depict only exemplary embodiments and are not therefore to be considered limiting in scope, the exemplary embodiments will be described with additional specificity and detail through the use of the accompanying drawings, in which.

DETAILED DESCRIPTION

Figure 1A:
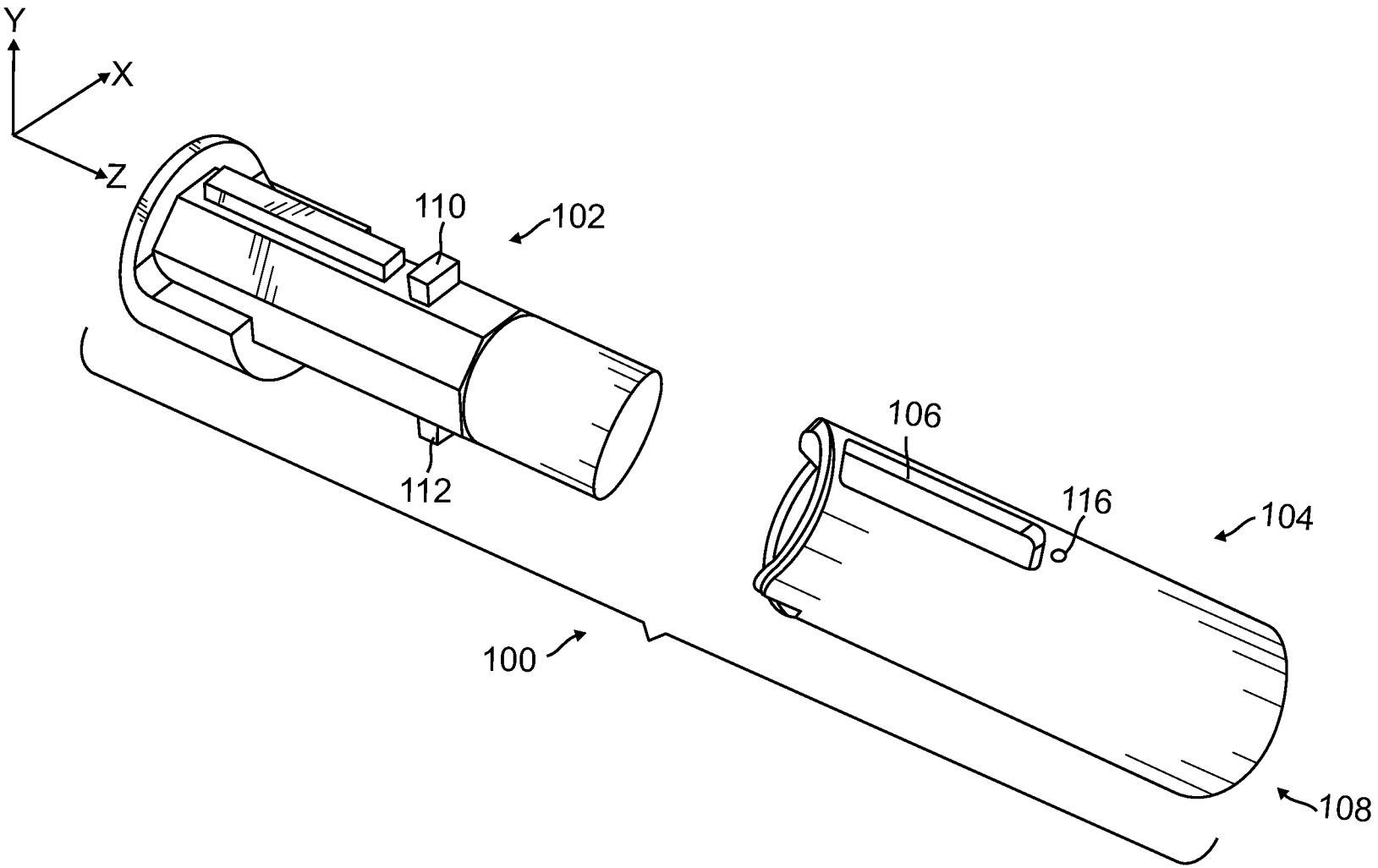
FIG. 1A is an exploded, perspective view of one embodiment of a coaxial antenna feed with mode suppression.

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

Embodiments of the present invention provide an antenna feed that transmits signals with circular polarization having an improved axial ratio. It has been discovered that the axial ratio in existing systems increases due to the existence of unwanted modes of electromagnetic wave propagation in the antenna feed. These unwanted modes are induced due to mismatches in components at various frequencies and operating temperatures in the antenna feed. Antenna feeds constructed according to the teachings of the present invention are configured to suppress these unwanted modes and thus reduce (improve) the axial ratio and the performance of the antenna feed.

Specifically, embodiments of the present invention include an antenna feed with a coaxial, transition section coupled to a polarizer section and a radiator section (see FIG. 7, described in more detail below). The transition section includes inner and outer conductors. The transition section has been improved over existing systems to include features that reduce the unwanted modes. Specifically, in some embodiments, the inner and outer conductors of the transition section are shorted together (either by direct contact using a conductor or through capacitive coupling) close to an interface with a rectangular waveguide that feeds the coaxial section. The short has the advantageous effect of reducing unwanted modes that arise when there are reflections from the radiator section. This is referred to herein as "mode suppression" and it improves the axial ratio of the antenna feed.

A transition section without mode suppression is shown in U.S. application Ser. No. 13/975,683, the disclosure of which is incorporated herein by reference. The transition section, with or without mode suppression includes a coaxial antenna feed that launches a horizontal $TE_{11}$ mode but does not launch the vertical $TE_{11}$ mode or the TEM mode. FIG. 1B establishes a frame of reference for vertical (V) and horizontal (H) modes of electromagnetic radiation. In the remainder of this specification, reference to the horizontal or vertical mode is understood to include the $TE_{11}$ modes of a coaxial waveguide. The horizontal mode goes through the polarizer where it is converted to a right-hand circularly polarized wave (RHCP). If the radiator section is not well matched, a portion of this wave is reflected back as a left-hand circularly polarized (LHCP) wave. The polarizer converts the LHCP wave to vertical polarization at the transition section. The vertical wave impinging on the transition section is reflected as a TEM wave which travels through the polarizer hits the radiator and is completely reflected. The reflected TEM wave travels back through the polarizer and strikes the transition section. At the transition section, the TEM wave is converted to vertical polarization which goes through the polarizer and radiates as LHCP. These multiple mode conversions and the corresponding radiation of the LHCP wave degrade the axial ratio of the desired RHCP signal. If the radiator were well matched at all frequencies and operating temperatures, there may not be an issue. However, the radiator is narrow-band and its impedance varies with temperature and thus these unwanted modes are excited in the conventional antenna feed. The above discussion is one example where RHCP is the desired polarization. If LHCP is desired, the polarizer would be designed accordingly and terms RHCP and LHCP would be interchanged in the preceding paragraph.

Further, in some embodiments, the antenna feed further includes a resistive sheet on a dielectric block located between the inner and outer conductors and positioned to absorb reflected power in an undesired vertical mode in the transition section. This also helps reduce the existence of undesired modes in the antenna feed and thus improves the axial ratio and performance of the antenna feed.

Figure 1B:
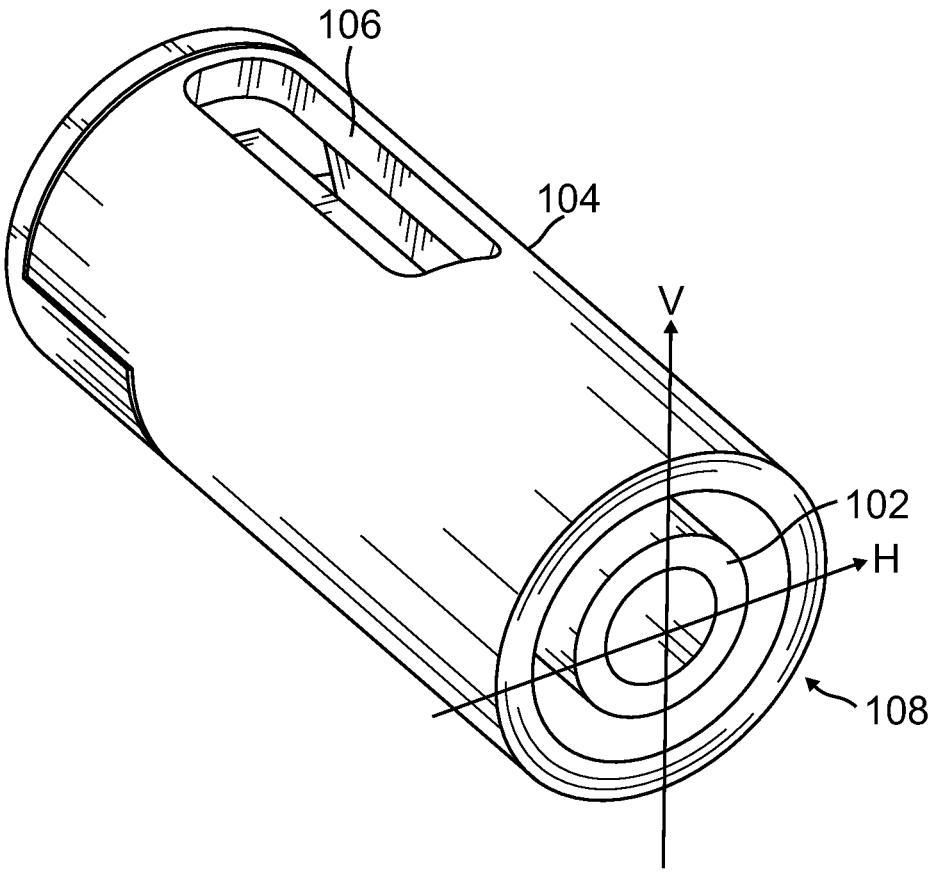
FIG. 1B is a perspective view of the embodiment of FIG. 1A with designations for horizontal and vertical vectors.

FIG. 1A is an exploded perspective view of a transition section, indicated generally at 100, of an antenna feed according to one embodiment of the present invention. Transition section 100 is a coaxial waveguide and includes inner conductor 102 and outer conductor 104. In FIG. 1, outer conductor 104 slides in place over inner conductor 102 so that outer conductor 104 and inner conductor 102 form a coaxial waveguide. Outer conductor 104 includes window opening 106 that provides a first port of the coaxial waveguide. A second port of the coaxial waveguide is indicated at 108. Electromagnetic energy received at window 106 launches a horizontal wave ($TE_{11}$ mode) in the coaxial waveguide toward second port 108. Other modes of electromagnetic propagation in the transition section 100 also may arise due to reflections at an interface at port 108 with other portions of the antenna feed as described above. Advantageously, transition section 100 is designed with additional features that suppress these other modes thereby improving the overall performance of the antenna feed. In some embodiments, this overall improvement includes an improved axial ratio of the electromagnetic fields radiated from the output of the antenna feed.

Figure 1C:
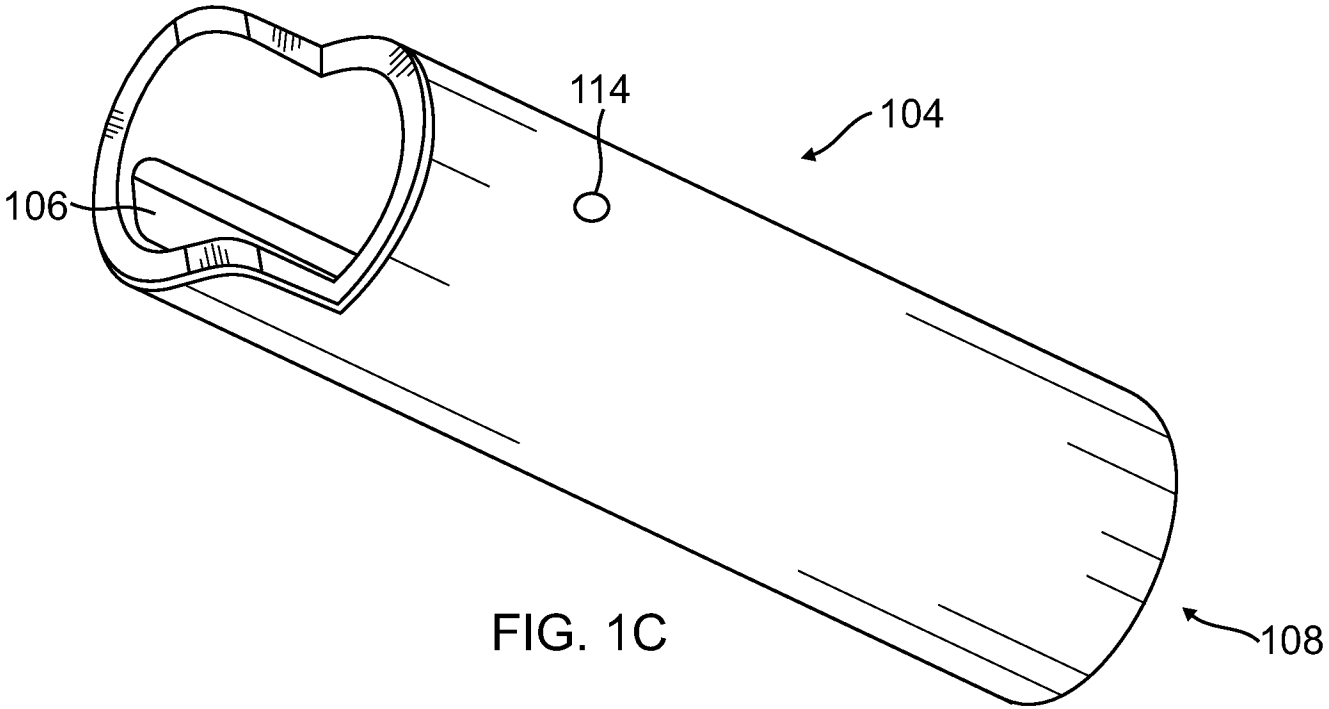
FIG. 1C is a perspective view of the outer conductor of the embodiment of FIG. 1A.

Transition section 100 includes a short between inner conductor 102 and outer conductor 104 located adjacent to the window 106. In the embodiment of FIG. 1, inner conductor 102 includes a pair of conductive blocks 110 and 112 that are used to short the inner conductor 102 to the outer conductor 104. Conductive block 110 is disposed above the z-axis and is attached to, or made as part of, the surface of the inner conductor 102. Similarly, conductive block 112 is disposed below the z-axis and attached to, or made a part of, the surface of the inner conductor 102. In one embodiment, conductive block 112 is located opposite conductive block 110 approximately half-way around the circumference of inner conductor 102. Outer conductor 104 also includes opening 116. When outer conductor 104 is moved into position around inner conductor 102, opening 116 lines up with conductive block 110. An electrical short between outer conductor 104 and inner conductor 102 is formed by, for example, a laser weld through opening 116 that physically connects conductive block 110 with outer conductor 104. Similarly, a laser weld is formed through opening 114 (FIG. 1C) on a bottom surface of outer conductor 104 to connect outer conductor 104 with conductive block 112. Alternatively, the connection between outer conductor 104 and conductive blocks 110 and 112, in other embodiments, is formed by means of solder, conductive elastomeric gaskets commercially available from Laird Technologies or Parker Hannifin Chomerics Corp., or fuzz buttons from Custom Interconnects, LLC.

Figure 2:
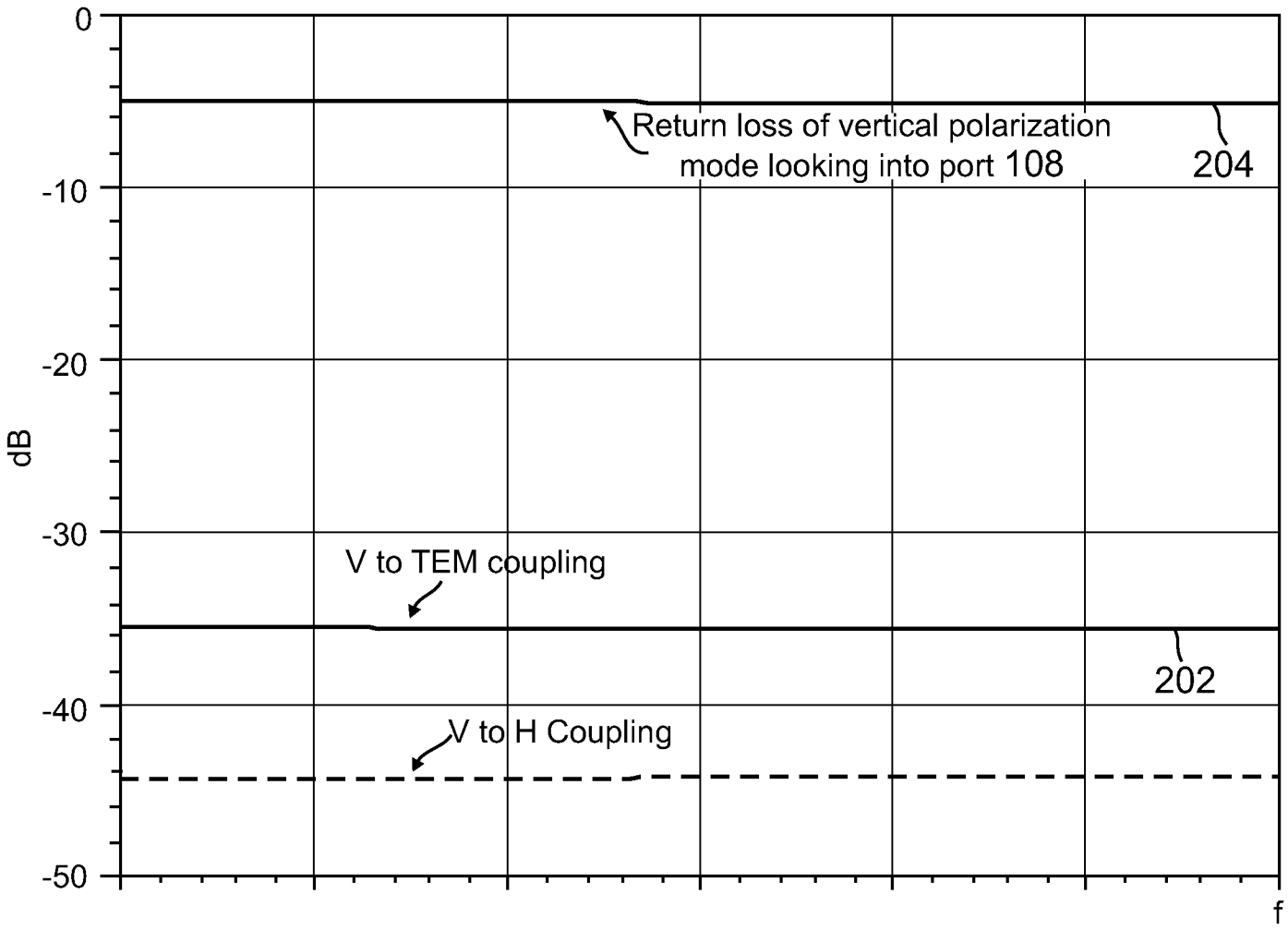
FIG. 2 is a graph illustrating the suppression of unwanted modes in the embodiment of FIGS. 1A, 1B, and 1C.

FIG. 2 is a graph that illustrates the improvements in the transition section 100 by incorporating the short between inner conductor 102 and outer conductor 104 of FIG. 1A. First, curve 202 demonstrates that the addition of a short between inner conductor 102 and outer conductor 104 adjacent to window 106 reduces coupling between the vertical and TEM modes of electromagnetic wave propagation to below −30 dB. When the transition section 100 is used in an antenna feed, such as shown in FIG. 7, this reduction in coupling between the vertical and TEM modes has the beneficial effect of improving the axial ratio of the output of an antenna feed. However, it is noted that curve 204 demonstrates that the return loss of vertical polarization mode looking into port 108 is only reduced to about −5 dB. A return loss at this level can still degrade the axial ratio of the antenna feed.

Figure 3:
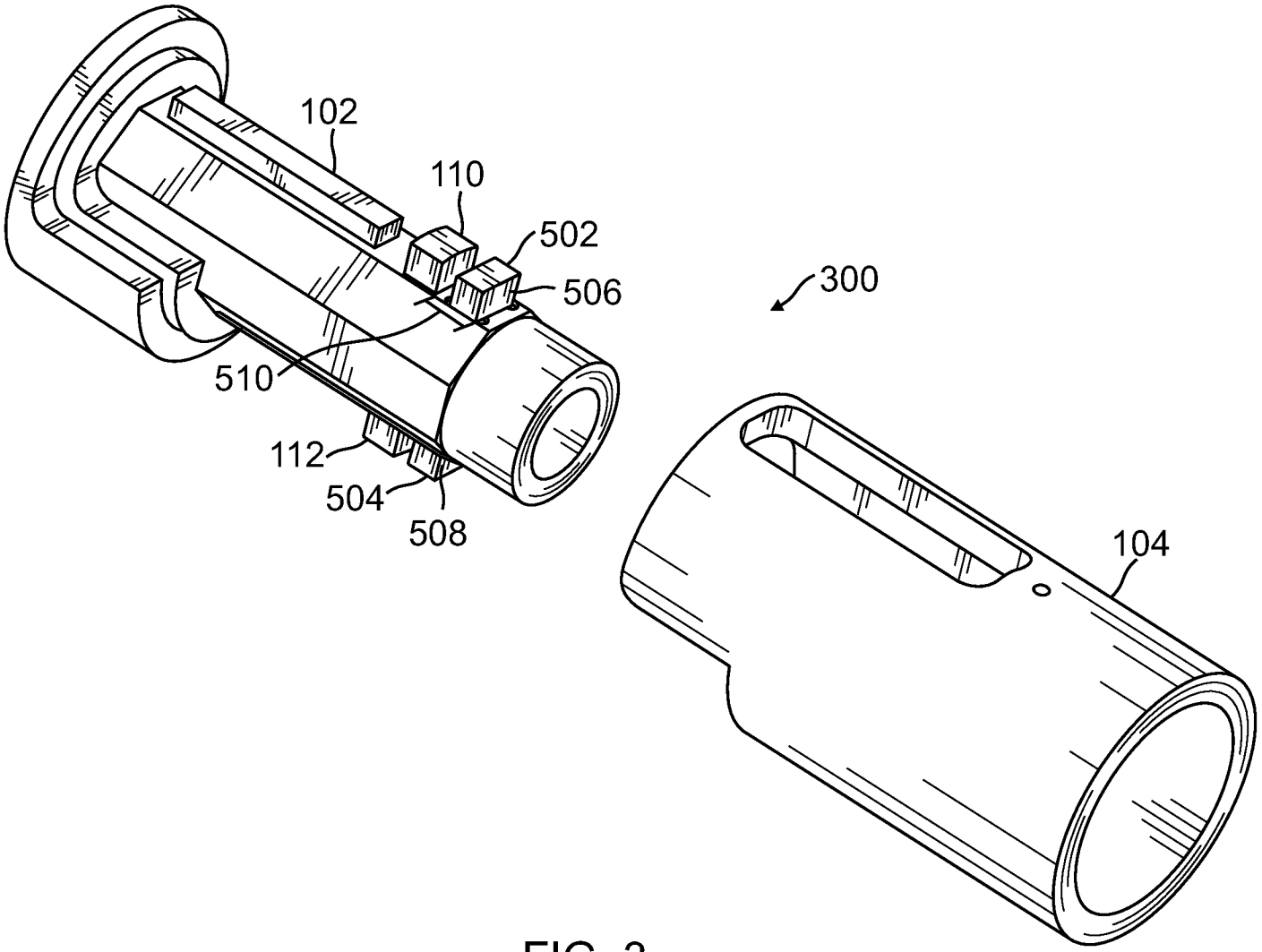
FIG. 3 is an exploded, perspective view of another embodiment of a coaxial antenna feed with mode suppression.

FIG. 3 illustrates another embodiment of a transition section for an antenna feed with a further enhancement to reduce unwanted modes of electromagnetic wave propagation and thereby improve the axial ratio. In this embodiment, a dielectric block 502 is added between outer conductor 104 and inner conductor 102. In one embodiment, dielectric block 502 is formed from ALUMNA which is commercially available from CoorsTek, Inc or Trans-Tech, Inc. Dielectric block 502 includes a resistive sheet 506 formed on a surface of block 502 that is furthest from the short formed by conductive block 110. The resistive sheet 506 is formed by vapor deposition or sputtering a thin (measured in angstroms) metallic layer onto the dielectric block 502. One example uses 50% Nickel and 50% Chrome also called 50-50 Nichrome at a specified thickness to result in the desired Ohms per square sheet resistance. As indicated at 510, resistive sheet 506 of dielectric block 502 is placed approximately 0.15 guide wavelengths in front of first conductive block 110.

The embodiment of FIG. 3 further includes a second dielectric block 504 disposed on an opposite side of inner conductor 102 approximately halfway around the circumference of inner conductor 102. Second dielectric block 504 is also placed approximately 0.15 guide wavelengths in front of second conductive block 112 and includes a resistive sheet 508. In general, the distance 510 is greater than ⅛ guide wavelength and less than ¼ guide wavelength. The exact dimension 510 will vary depending upon the other geometrical dimensions of the structure and is found through numerical optimization using full wave electromagnetic analysis software such as ANSYS HFSS, commercially available from ANSYS, Inc., or CST Microwave Studio, commercially available from CST Computer Simulation Technology AB.

Figure 4:
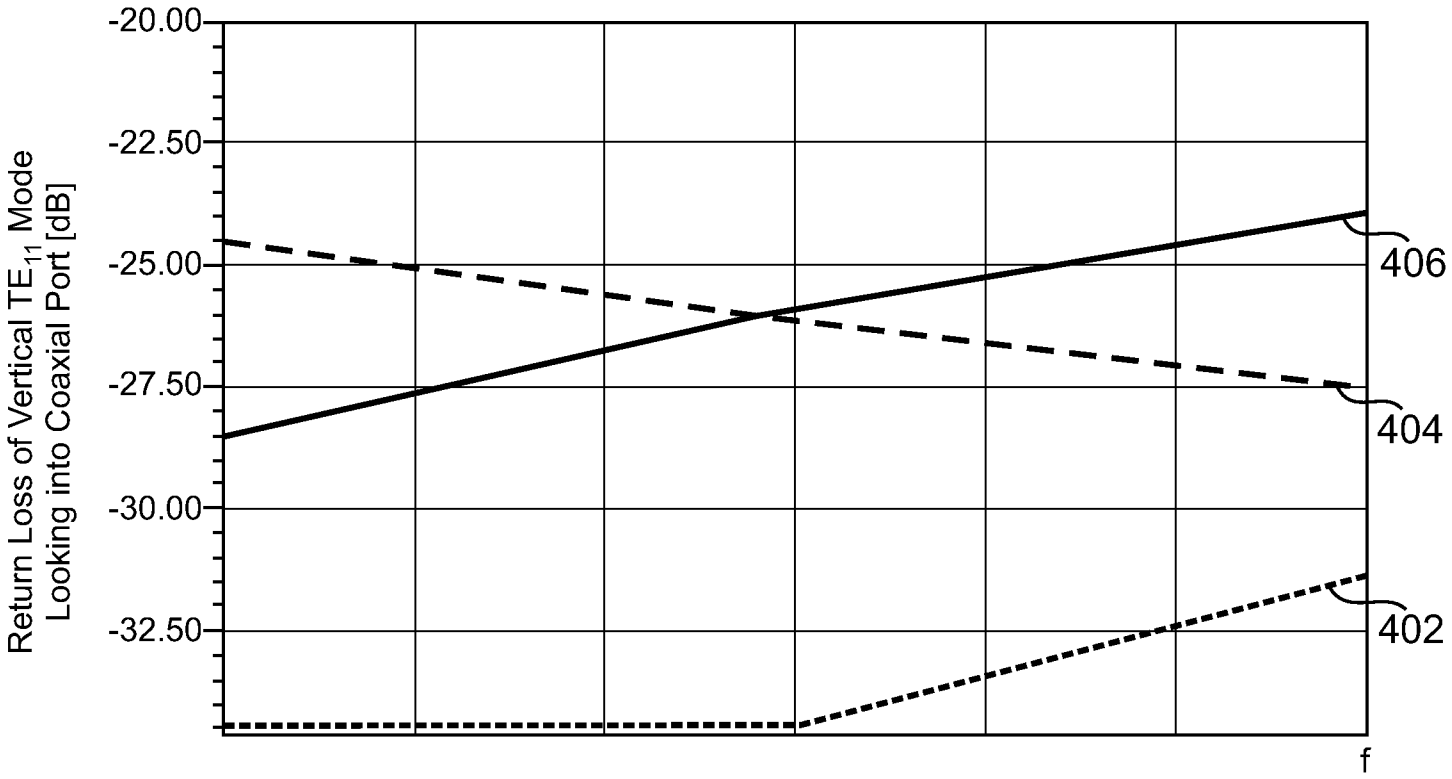
FIG. 4 is a graph that illustrates the suppression of an unwanted mode in the embodiment of FIG. 3.

FIG. 4 is a graph that illustrates the effect of the addition of the dielectric blocks to the transition section of an antenna feed. Curves 402, 404, and 406 illustrate the return loss of the vertical polarization mode looking into the coaxial port of the transition section of FIG. 3 with resistivity on the dielectric block of −10% of a nominal resistivity, nominal resistivity, and +10% over a nominal resistivity, respectively. Vertical polarization return loss, in this case, is a measure of the relative amount of power in the vertical $TE_{11}$ mode that is reflected from the transition back toward the polarizer and radiator sections. As can be seen from FIG. 4, the vertical polarization return loss at each level of resistivity is below at least −22.5 dB, a marked improvement from the −5 dB value of FIG. 2. Therefore, the addition of the dielectric block and resistive sheet has suppressed another unwanted mode of electromagnetic energy in the transition section. This vertical $TE_{11}$ mode, being absorbed by the resistive sheets, will not propagate toward the polarizer and radiator to cause interference with the desired mode of circular polarization.

Figure 5:
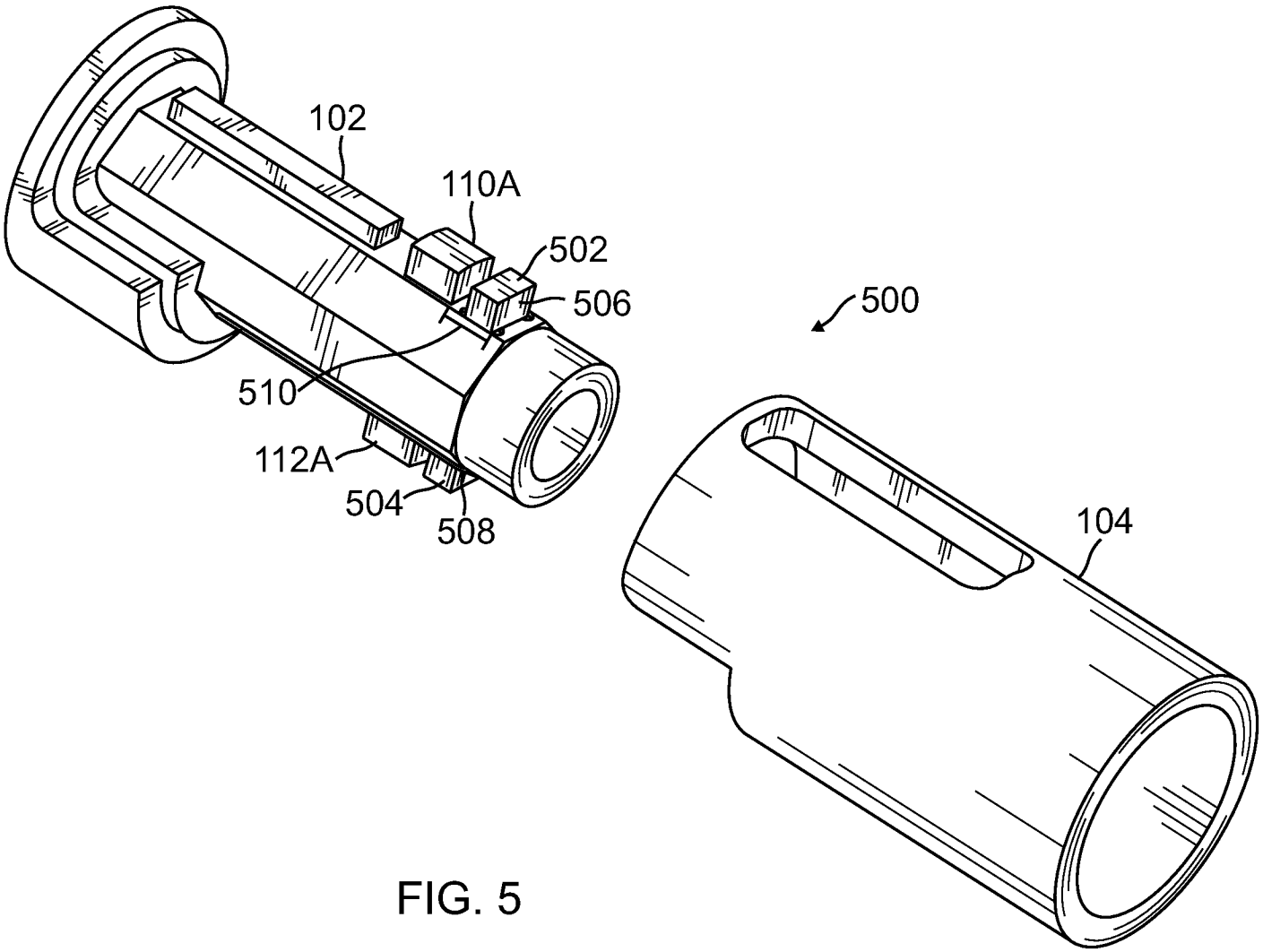
FIG. 5 is an exploded, perspective view of another embodiment of a coaxial antenna feed with mode suppression.

FIG. 5 is an exploded, perspective view of another embodiment of a transition section, indicated at 500, for an antenna feed with mode suppression. In this embodiment, inner conductor 102 is capacitively coupled to outer conductor 104 by conductive blocks 110A and 112A. As with the embodiment of FIGS. 1A and 3, conductive blocks 110A and 112A are attached to, or made as part of, the surface of the inner conductor 102. In this embodiment, however, the conductive blocks 110A and 112A are formed to have a height such that the conductive blocks 110A and 112A come close to, but do not contact, the inner surface of outer conductor 104 thereby providing the desired shorting of the inner conductor 102 and the outer conductor 104 by capacitive coupling. This capacitive coupling of the inner conductor 102 and the outer conductor 104 advantageously suppresses the undesired modes of electromagnetic wave propagation.

Figure 6A:
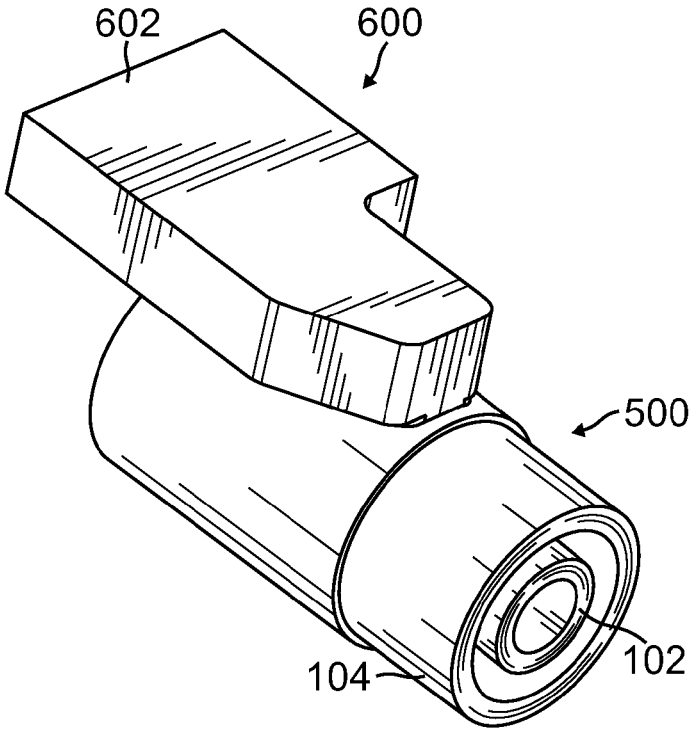
FIGS. 6A and 6B are perspective views of another embodiment of an antenna feed with mode suppression.
Figure 6B:
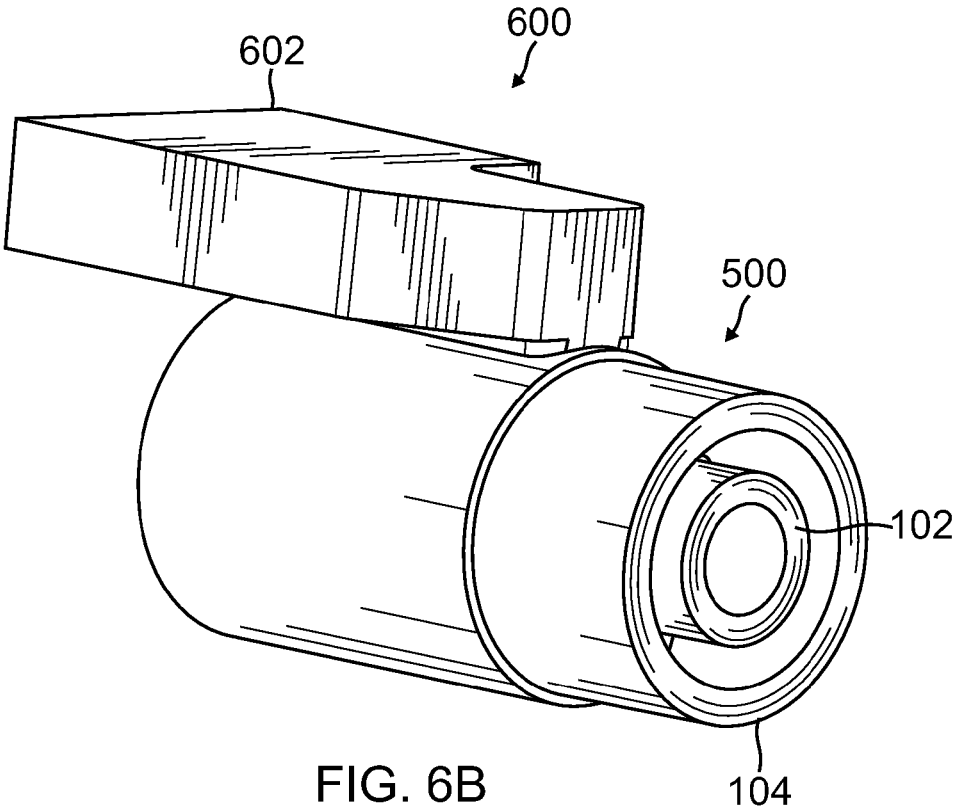
Figure 6C:
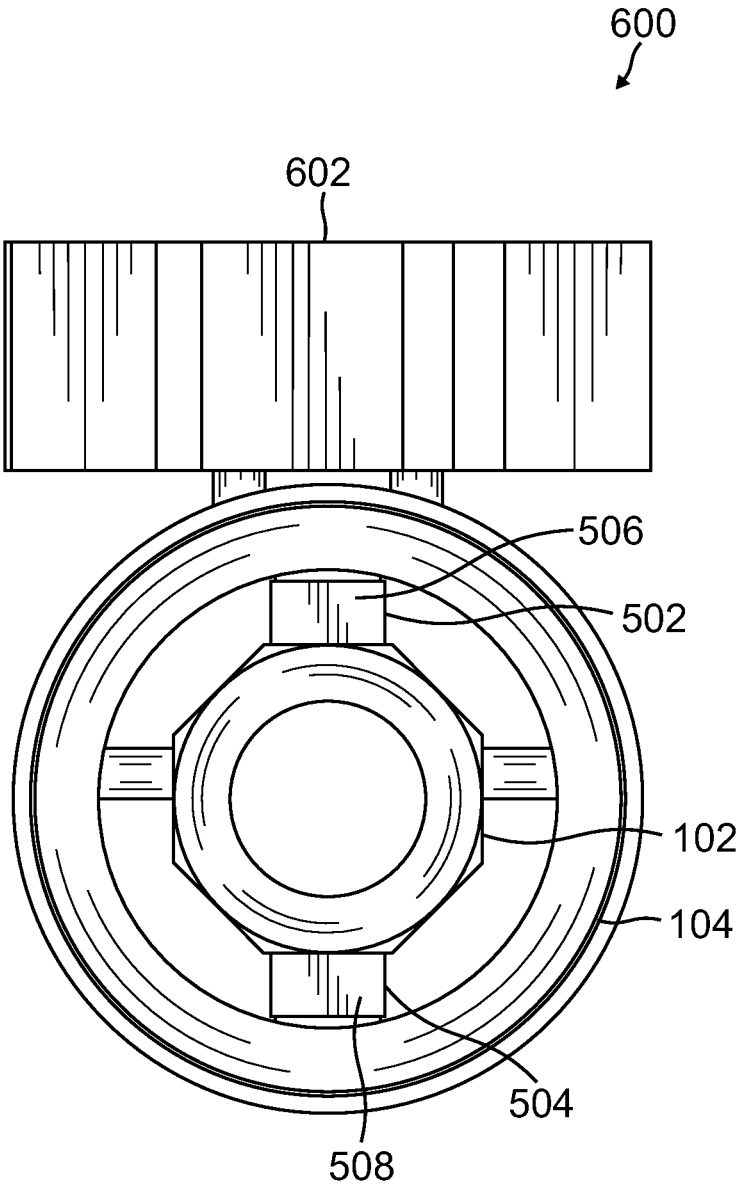
FIG. 6C is a front view of the embodiment of FIGS. 6A and 6B looking into a port of the antenna feed.
Figure 6D:
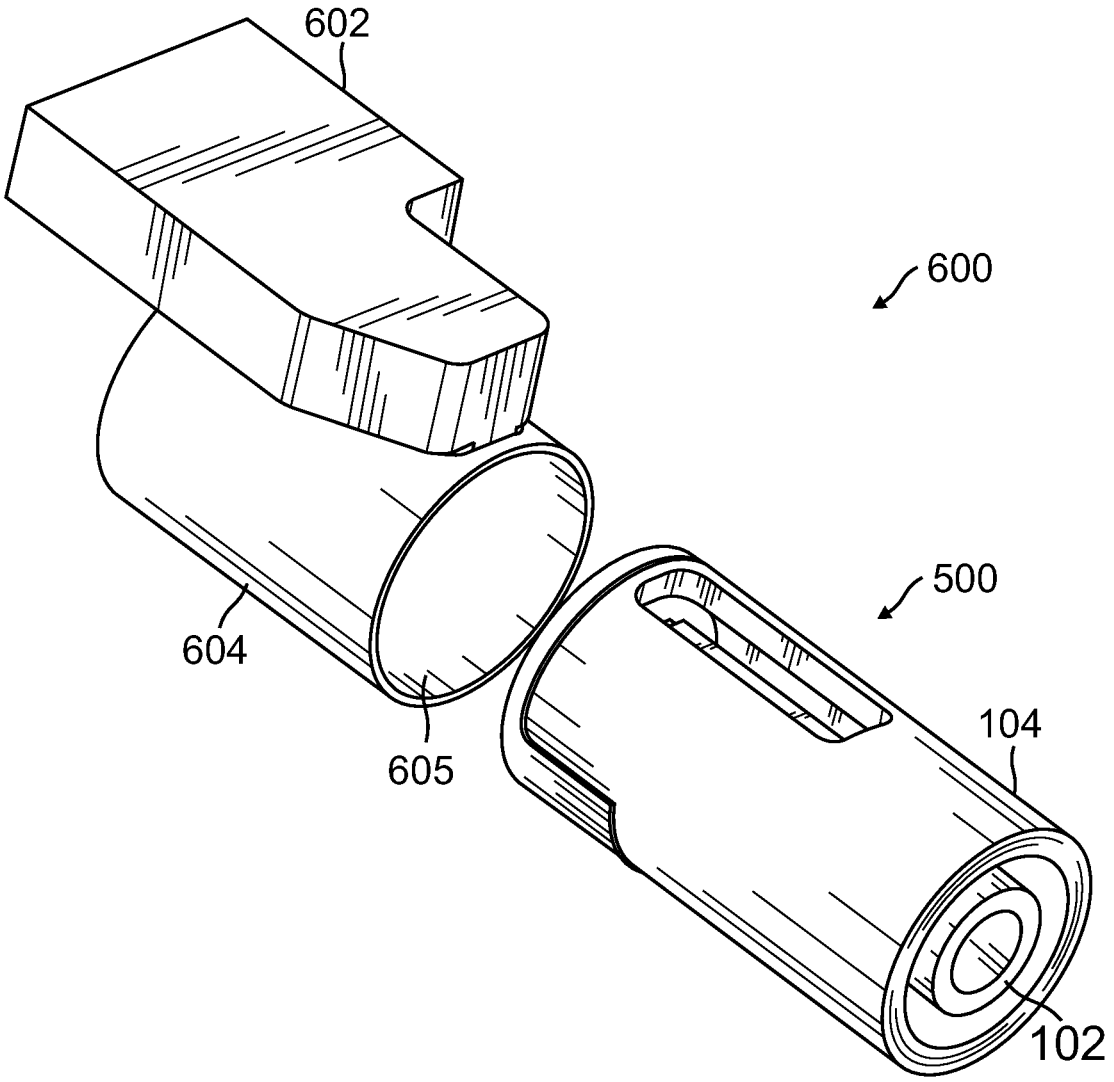
FIG. 6D is an exploded, perspective view of the embodiment of FIGS. 6A and 6B.
Figure 6E:
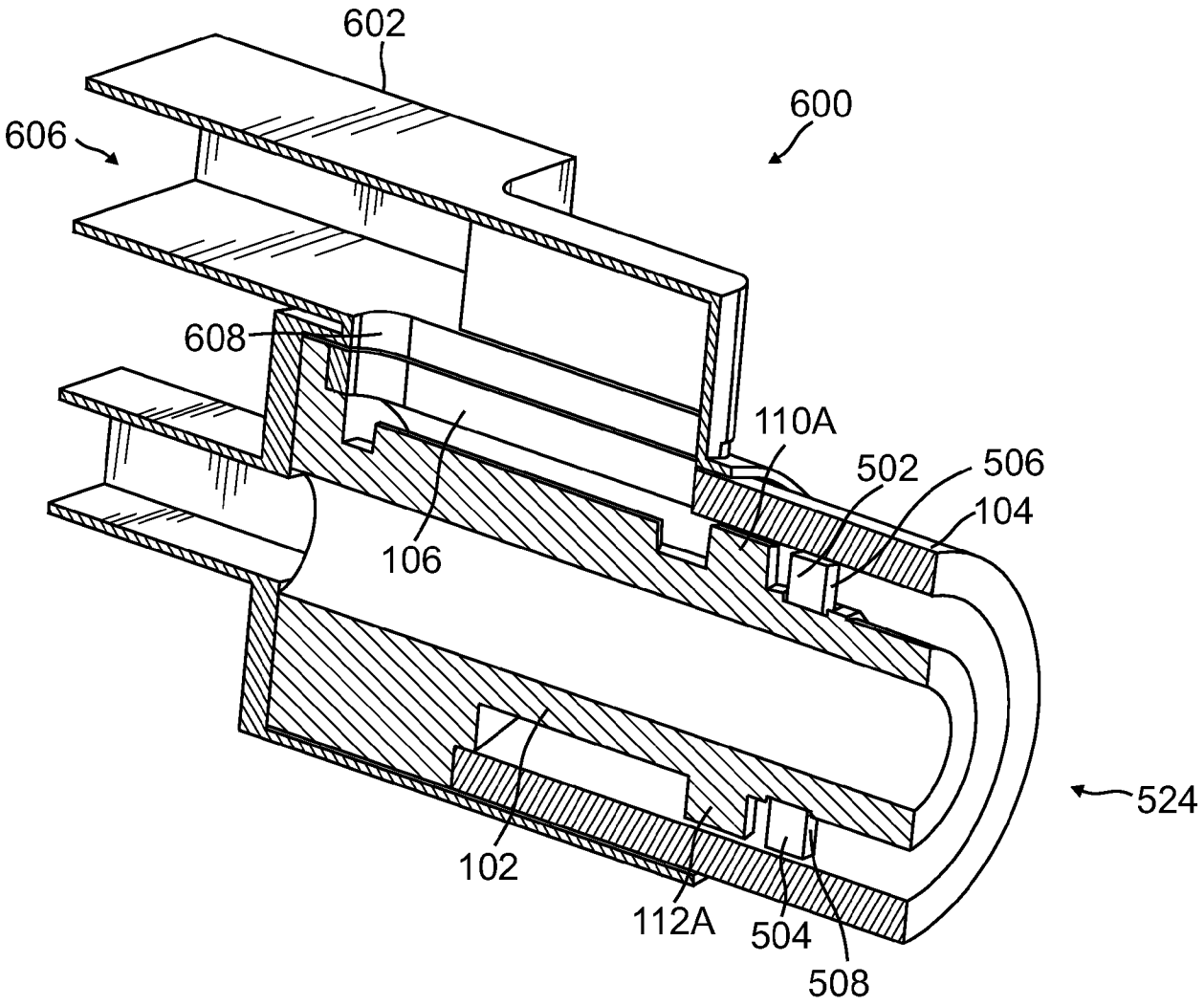
FIG. 6E is a perspective view in cross section of the embodiment of FIGS. 6A and 6B.

FIGS. 6A through 6E illustrate various views of another embodiment of an antenna feed 600 according to the teachings of the present invention. Antenna feed 600 includes a transition section with mode suppression. In one embodiment, antenna feed 600 uses transition section 500 of FIG. 5 with a capacitive short between inner conductor 102 and outer conductor 104 as shown in FIGS. 6D and 6E. However, it is understood that antenna feed 600 uses, in other embodiments, transition sections such as shown and described above with respect to FIGS. 1A-1C and FIG. 3.

In addition to transition section 500, antenna feed 600 includes rectangular waveguide 602. As shown in FIG. 6D, waveguide 602 is coupled to sleeve 604. Transition section 500 is inserted into opening 605 of sleeve 604. There are other methods, known to those skilled in the art of mechanical design, for attaching the transition section to the rectangular waveguide that may not use the sleeve as shown. For example, a coaxial feed with increased metal thickness and rectangular waveguide housing with additional metal support structure may allow room for screws. The embodiments of FIGS. 6A-6E are particularly useful where compact dual-frequency feeds are needed such as applications requiring multiple antenna feeds in a small form factor.

FIG. 6E is a cross-sectional, side view of antenna feed 600 that illustrates the signal path through antenna feed 600. Antenna feed 600 includes a first port 606 at the waveguide 602 that is coupled to receive an input signal for the antenna feed 600 from a signal source. The electromagnetic wave in rectangular waveguide 602 passes though opening 608 of rectangular waveguide 602 to opening 106 of transition section 500. Transition section 500 launches the horizontal $TE_{11}$ mode which propagates to coaxial port 524. Transition section 500 includes conductive blocks 110A and 112A that provide a short between inner conductor 102 and outer conductor 104 to suppress unwanted modes of electromagnetic wave propagation. In this embodiment, the short is accomplished by capacitive coupling. In other embodiments, the conductive blocks are brought into contact with outer conductor 102 as described above with respect to FIG. 1A. Transition section 500 also includes dielectric blocks 502 and 504 (with resistive sheets) as described above to aid in suppressing the unwanted modes.

Figure 7:
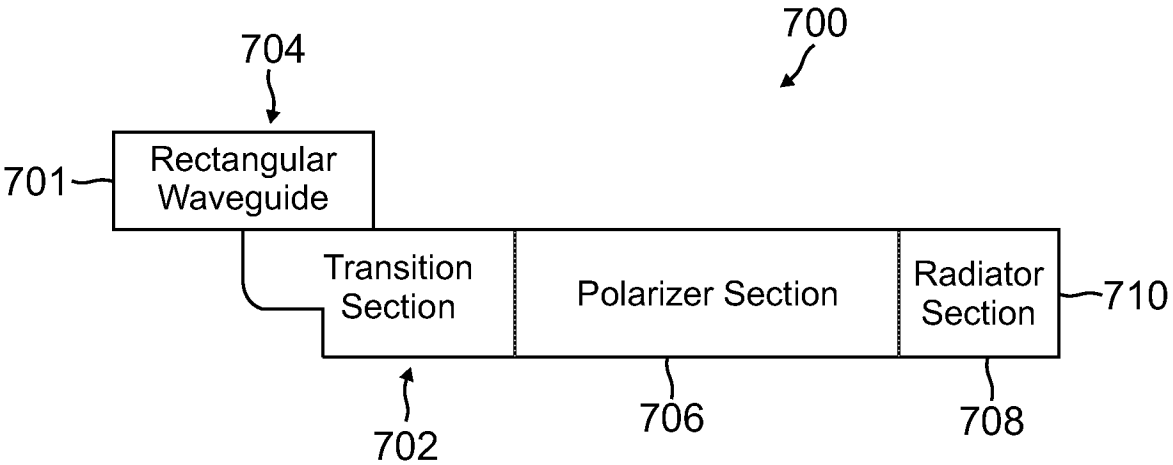
FIG. 7 is a side view of an antenna feed with mode suppression according to one embodiment of the present invention.

FIG. 7 is a side view of an antenna feed 700 that includes a transition section 702 that suppresses unwanted modes of electromagnetic wave propagation. Antenna feed 700 includes an input port 701 of rectangular waveguide 704. Input port 701 is coupled to some source of input signal. Rectangular waveguide 704 is coupled to transition section 702. Transition section 702 is constructed as described above, for example, with respect to any one or more of FIGS. 1-3 and 5. As such, transition section 702 acts to suppress unwanted modes of electromagnetic wave propagation as described above. Transition section 702 is coupled to polarizer section 706. Polarizer section 706 implements circular polarization on the output of transition section 702. Polarizer section 706 is coupled to radiator section 708. Radiator section 708 includes output port 710 that acts as an output for antenna feed 700. By including transition section 702 with mode suppression, the output from radiator section 708 at output port 710 has circular polarization with improved axial ratio.

Figure 8:
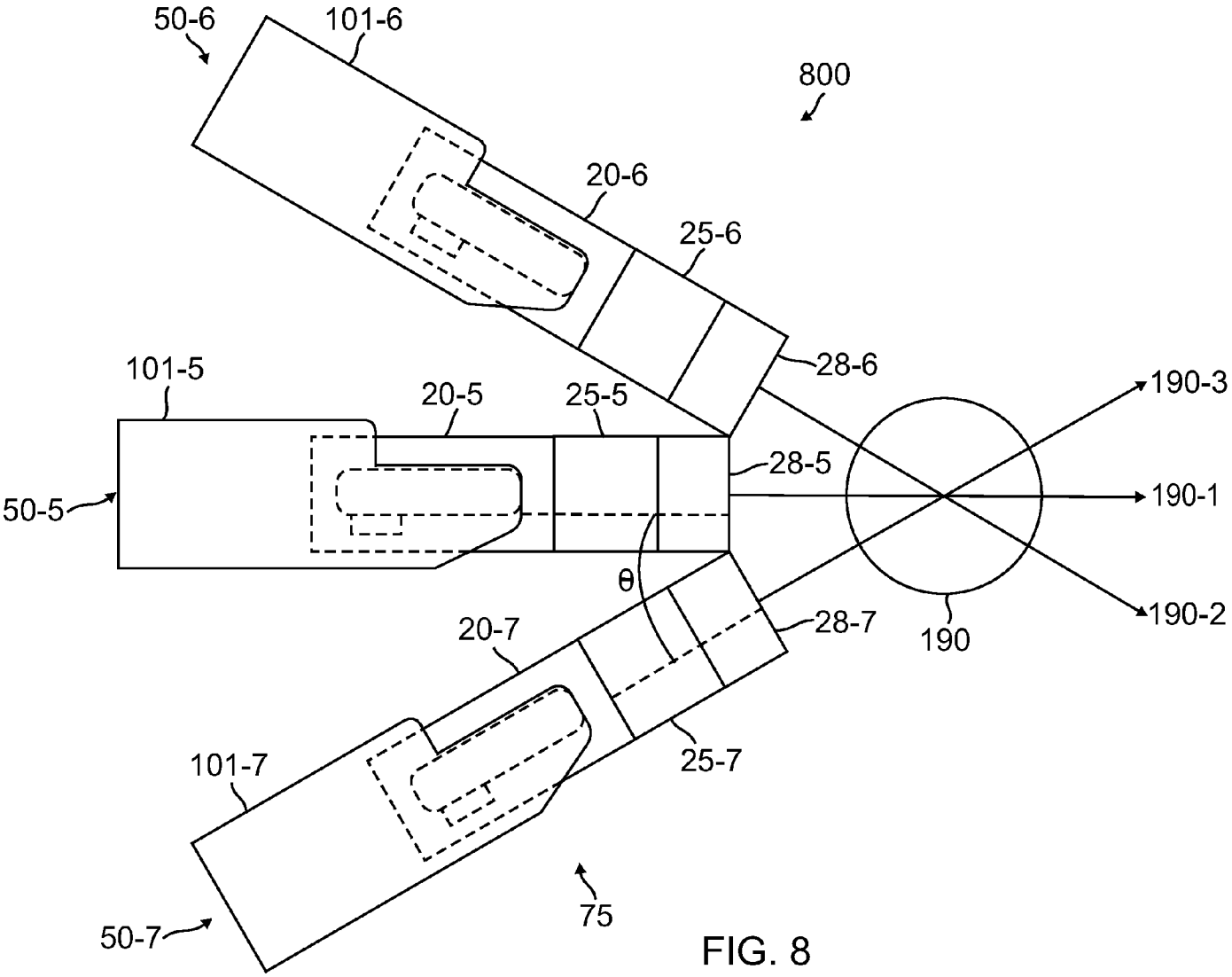
FIG. 8 is a top view of a communication system with a plurality of antenna feeds with mode suppression according to one embodiment of the present invention.

FIG. 8 is a top view of a communication system 800 including a plurality of closely spaced antenna feeds 50-5, 50-6, and 50-7. Each of antenna feeds 50-5, 50-6 and 50-7 uses mode suppression to improve the axial ratio of the signals transmitted by system 800. The closely spaced antenna feeds 50-5, 50-6, and 50-7 function as a switched beam array, or a feed system 75 to feed communication signals to an antenna of communication system 800 from one or more signal sources. In operation as a switched beam array 75, only one of antenna feeds 50-5, 50-6, or 50-7 is energized at a time.

The closely spaced antenna feeds 50-5, 50-6, and 50-7 include rectangular waveguides 101-5, 101-6, and 101-7, which function as the rectangular waveguide 704 described above with reference to FIG. 7. Antenna feeds 50-5, 50-6, and 50-7 also include transition sections 20-5, 20-6, and 20-7, respectively, that are constructed and function as described above with respect to one or more of FIGS. 1A-1C, 3 and 5. Antenna feeds 50-5, 50-6 and 50-7 also include polarizer sections 25-5, 25-6, and 25-7, respectively as well as radiator sections 28-5, 28-6, and 28-7.

A coupling lens 190 is arranged at the output end of the radiator sections 28-5, 28-6, and 28-7. The antenna feeds are arranged around the lens such that a straight line (190-1, 190-2, 190-3) can be drawn from each feed through the center of the lens 190. The beam pointing direction of the switched beam antenna 75 changes as a different radiating section 28-5, 28-6, or 28-7 is selected. The near field energy of a selected feed illuminates the entire lens. However, to an observer far away from the antenna, the beam appears as if it followed a line-of-sight path from the feed through the center of the lens and into the far field.

EXAMPLE EMBODIMENTS

Example 1 includes an antenna feed with mode suppression. The antenna feed comprising: a transition section, having a window for connecting to an output port of a rectangular waveguide and having inner and outer conductors forming a coaxial waveguide, wherein the coaxial waveguide couples energy from the rectangular waveguide into a horizontal $TE_{11}$ mode signal in the coaxial waveguide; a polarizer section, coupled to the transition section, the polarizer section, generating circular polarization from the horizontal mode of the transition section; a radiator section, coupled to the polarizer, the radiator section providing an output signal for the antenna feed; wherein the transition section includes: an electrical short coupling the inner and outer conductors of the coaxial waveguide, the electrical short disposed adjacent to the window of the transition section; and a dielectric block, disposed between the inner and outer conductors and adjacent to the electrical short along the axis of the coaxial waveguide, a surface of the dielectric block coated with a thin film sheet resistance.

Example 2 includes the antenna feed of Example 1, wherein the electrical short comprises: one or more conductive blocks that are attached to, or made part of, the inner conductor; and one of a laser weld, solder, a conductive elastomeric gasket, and fuzz buttons that couple the one or more conductive blocks to the outer conductor to short the inner conductor to the outer conductor.

Example 3 includes the antenna feed of any of Examples 1-2, wherein the electrical short comprises a capacitive coupling of the inner conductor to the outer conductor.

Example 4 includes the antenna feed of any of Examples 1-3, wherein the resistive surface of the dielectric block is located greater than ⅛ guide wavelength and less than ¼ guide wavelength from the electrical short.

Example 5 includes the antenna feed of any of Examples 1-4, wherein the electrical short comprises first and second electrical shorts.

Example 6 includes the antenna feed of Example 5, wherein the first electrical short comprises a conductive block located between the inner and outer conductors and adjacent to the window.

Example 7 includes the antenna feed of Example 6, wherein the second electrical short comprises a second conductive block located between the inner and outer conductors and centered at a location that is substantially half-way around the circumference of the inner conductor.

Example 8 includes a communication system comprising: a plurality of antenna feeds coupled to receive a signal from one or more signal sources; a coupling lens arranged to receive signals from the plurality of antenna feeds; and wherein the antenna feed comprises a coaxial waveguide, the coaxial waveguide having an inner conductor and an outer conductor, the inner and outer conductors shorted proximate an input port of coaxial waveguide to suppress undesired modes.

Example 9 includes the communication system of Example 8, wherein the coaxial waveguide includes a conductive block formed on the inner conductor that is shorted to the outer conductor.

Example 10 includes the communication system of Example 9, wherein the conductive block is one of capacitively or physically coupled to the outer conductor.

Example 11 includes the communication system of any of Examples 9-10, and further comprising a dielectric block disposed adjacent to the conductive block.

Example 12 includes the communication system of Example 11, wherein the dielectric block includes a resistive sheet formed on a face of the dielectric block that is furthest from the conductive block.

Example 13 includes the communication system of Example 12, wherein the resistive sheet is greater than ⅛ guide wavelength and less than ¼ guide wavelength from the conductive block.

Example 14 includes a method for manufacturing an antenna feed, the method comprising: forming a transition section, the transition section having a window for connecting to an output port of a rectangular waveguide and having inner and outer conductors that form a coaxial waveguide along a Z-axis of a coordinate system, wherein the coaxial waveguide couples energy from the rectangular waveguide into a horizontal mode signal in the coaxial waveguide; electrically shorting the inner and outer conductors of the coaxial waveguide at a location that is adjacent to the window of the transition section; disposing a dielectric block between the inner and outer conductors and adjacent to the location of the electrical short along the Z-axis of the coaxial waveguide; coupling a polarizer section to the transition section, the polarizer section generating circular polarization from the horizontal mode of the transition section; and coupling a radiator section to the polarizer, the radiator section providing an output signal for the antenna feed.

Example 15 includes the method of Example 14, wherein disposing the dielectric block comprises disposing the dielectric block at a greater than ⅛ guide wavelength and less than ¼ guide wavelength from the location of the electrical short along the Z-axis.

Example 16 includes the method of any of Examples 14-15, and further comprising coating a surface of the dielectric block with a resistive material.

Example 17 includes the method of Example 16, wherein coating the surface comprises coating a surface of the dielectric block that is in the X-Y plane and is furthest from the electrical short.

Example 18 includes the method of any of Examples 14-17, wherein electrically shorting the inner and outer conductors comprises one of physically shorting or capacitively shorting the inner and outer conductors.

Example 19 includes the method of any of Examples 14-18, wherein electrically shorting the inner and outer conductors comprises physically shorting the inner and outer conductors with one of a laser weld, solder, a conductive elastomeric gasket, and fuzz buttons.

Example 20 includes the method of any of Examples 14-19, wherein electrically shorting the inner and outer conductors comprises shorting the inner and outer conductors with a conductive block that extends from the inner conductor to form a capacitive coupling with the outer conductor.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. An antenna feed with mode suppression, the antenna feed comprising:

a transition section having a window for connecting to an output port of a rectangular waveguide and having inner and outer conductors forming a coaxial waveguide, wherein the inner conductor is positioned within the outer conductor, wherein the coaxial waveguide couples energy from the rectangular waveguide into a horizontal $TE_{11}$ mode signal in the coaxial waveguide;

a polarizer section coupled to the transition section, the polarizer section generating circular polarization from the horizontal mode of the transition section;

a radiator section coupled to the polarizer section, the radiator section providing an output signal for the antenna feed;

wherein the transition section includes:

an electrical short coupling the inner and outer conductors of the coaxial waveguide, the electrical short disposed adjacent to the window of the transition section; and a dielectric block disposed between the inner and outer conductors and adjacent to the electrical short along the axis of the coaxial waveguide, a surface of the dielectric block coated with a thin film sheet resistance.

2. The antenna feed of claim 1, wherein the electrical short comprises:

one or more conductive blocks that are attached to, or made part of, the inner conductor; and one of a laser weld, solder, a conductive elastomeric gasket, and fuzz buttons that couple the one or more conductive blocks to the outer conductor to short the inner conductor to the outer conductor.

3. The antenna feed of claim 1, wherein the electrical short comprises a capacitive coupling of the inner conductor to the outer conductor.

4. The antenna feed of claim 1, wherein the surface of the dielectric block coated with the thin film sheet resistance is located greater than ⅛ guide wavelength and less than ¼ guide wavelength from the electrical short.

5. The antenna feed of claim 1, wherein the electrical short comprises a first electrical short and a second electrical short.

6. The antenna feed of claim 5, wherein the first electrical short comprises a conductive block located between the inner and outer conductors and adjacent to the window.

7. The antenna feed of claim 6, wherein the second electrical short comprises a second conductive block located between the inner and outer conductors and centered at a location that is substantially half-way around the circumference of the inner conductor.

8. A communication system comprising:

a plurality of antenna feeds coupled to receive a signal from one or more signal sources;

a coupling lens arranged to receive signals from the plurality of antenna feeds; and wherein each antenna feed of the plurality of antenna feeds comprises a coaxial waveguide, the coaxial waveguide having an inner conductor and an outer conductor, wherein the inner conductor is positioned within the outer conductor, the inner and outer conductors shorted proximate an input port of coaxial waveguide to suppress undesired modes, wherein the coaxial waveguide includes a dielectric block formed on the inner conductor, wherein the dielectric block includes a resistive sheet on a face of the dielectric block.

9. The communication system of claim 8, wherein the coaxial waveguide includes a conductive block formed on the inner conductor that is shorted to the outer conductor.

10. The communication system of claim 9, wherein the conductive block is one of capacitively or physically coupled to the outer conductor.

11. The communication system of claim 9, and wherein the dielectric block is disposed adjacent to the conductive block.

12. The communication system of claim 11, wherein the resistive sheet is formed on a face of the dielectric block that is furthest from the conductive block.

13. The communication system of claim 12, wherein the resistive sheet is greater than ⅛ guide wavelength and less than ¼ guide wavelength from the conductive block.

14. A method for manufacturing an antenna feed, the method comprising:

forming a transition section, the transition section having a window for connecting to an output port of a rectangular waveguide and having inner and outer conductors that form a coaxial waveguide along a Z-axis of a coordinate system, wherein the inner conductor is positioned within the outer conductor, wherein the coaxial waveguide couples energy from the rectangular waveguide into a horizontal mode signal in the coaxial waveguide;

electrically shorting the inner and outer conductors of the coaxial waveguide at a location that is adjacent to the window of the transition section;

disposing a dielectric block between the inner and outer conductors and adjacent to the location of the electrical short along the Z-axis of the coaxial waveguide;

coating a surface of the dielectric block with a resistive material;

coupling a polarizer section to the transition section, the polarizer section generating circular polarization from the horizontal mode of the transition section; and coupling a radiator section to the polarizer, the radiator section providing an output signal for the antenna feed.

15. The method of claim 14, wherein disposing the dielectric block comprises disposing the dielectric block at a greater than ⅛ guide wavelength and less than ¼ guide wavelength from the location of the electrical short along the Z-axis.

16. The method of claim 4, wherein coating the surface of the dielectric block with the resistive material comprises coating a surface of the dielectric block that is in the X-Y plane and is furthest from the electrical short.

17. The method of claim 14, wherein electrically shorting the inner and outer conductors comprises one of physically shorting or capacitively shorting the inner and outer conductors.

18. The method of claim 14, wherein electrically shorting the inner and outer conductors comprises physically shorting the inner and outer conductors with one of a laser weld, solder, a conductive elastomeric gasket, and fuzz buttons.

19. The method of claim 14, wherein electrically shorting the inner and outer conductors comprises shorting the inner and outer conductors with a conductive block that extends from the inner conductor to form a capacitive coupling with the outer conductor.

* * * * *